US006347572B1

(12) United States Patent
Martin et al.

(10) Patent No.: US 6,347,572 B1
(45) Date of Patent: Feb. 19, 2002

(54) HYDRAULIC MOTOR HAVING RADIAL PISTONS AND A SINGLE DECLUTCHING SELECTOR

(75) Inventors: Louis Martin, Compiegne; Jean-Marie Rouillard, La Croix Saint-Ouen; Jean-Pierre Souply, Senlis, all of (FR)

(73) Assignee: Poclain Hydraulics Industrie, Verberie (FR)

( * ) Notice: Subject to any disclaimer, the term of this patent is extended or adjusted under 35 U.S.C. 154(b) by 0 days.

(21) Appl. No.: 09/626,994

(22) Filed: Jul. 27, 2000

(30) Foreign Application Priority Data

Jul. 27, 1999 (FR) ..... 99 09714

(51) Int. Cl.[7] ..... F04B 7/04; F04B 19/00; F04B 43/00

(52) U.S. Cl. ..... 91/491; 486/473

(58) Field of Search ..... 91/491, 486, 479, 91/476, 473

(56) References Cited

U.S. PATENT DOCUMENTS 4,180,981 A * 1/1980 Pensa ..... 60/435
4,401,182 A * 8/1983 Pollman ..... 91/473
4,461,188 A * 7/1984 Fisher ..... 74/330
5,117,936 A * 6/1992 Nakamura et al. ..... 91/473

FOREIGN PATENT DOCUMENTS

| | | |
|---|---|---|
| FR | 2677409 | 12/1992 |
| FR | 2710111 | 3/1995 |
| WO | WO 9531641 | 11/1995 |

* cited by examiner

*Primary Examiner*—Timothy S. Thorpe
*Assistant Examiner*—Michael K. Gray
(74) *Attorney, Agent, or Firm*—Ladas & Parry

(57) ABSTRACT

A hydraulic motor comprising a cylinder block having at least a first group of radial cylinders, a reaction member mounted to rotate relative to the cylinder block, and an internal fluid distributor having distribution ducts. The motor further comprises a single declutching selector constrained to rotate with the cylinder block about the axis of rotation and provided with a communication duct for each cylinder of the first group of cylinders, the selector being suitable for taking up a first position, in which it is possible to connect the cylinder ducts of said cylinders to the distribution ducts, a second position, in which it is possible to declutch the pistons of the cylinders of the first group by putting the cylinder ducts of said cylinders in communication with a fluid discharge enclosure, and an intermediate transitional position between said first and second positions, and in which said cylinder ducts are connected together via an isolated enclosure.

20 Claims, 7 Drawing Sheets

HYDRAULIC MOTOR HAVING RADIAL PISTONS AND A SINGLE DECLUTCHING SELECTOR

FIELD OF THE INVENTION

The present invention relates to a hydraulic motor comprising:

a cylinder block which comprises at least a first group of cylinders disposed radially relative to an axis of rotation, each cylinder being connected to a cylinder duct and co-operating with a piston suitable for sliding in said cylinder;

a reaction member mounted to rotate relative to the cylinder block about the axis of rotation;

an internal fluid distributor constrained to rotate with the reaction member about the axis of rotation and provided with distribution ducts suitable for being connected to the cylinder ducts so as to put said ducts in communication with fluid inlet and fluid outlet ducts of the motor; and selection means suitable, in a first configuration, for making it possible to connect the cylinder ducts of the cylinders of the first group to the distribution ducts and, in a "piston-declutching" second configuration, for putting said cylinder ducts in communication with a fluid discharge enclosure, the pistons co-operating with the cylinders of the first group being suitable, in said declutching configuration, for being retracted into said cylinders towards the axis of rotation.

BACKGROUND OF THE INVENTION

A motor of that type is known from Document FR 2 710 111. When the motor operates at maximum cubic capacity, all of the cylinders are fed periodically with fluid under pressure. As is known, it is possible to interrupt feeding all of the cylinders periodically with fluid so that the motor delivers no torque. As is also known, it is possible to interrupt feeding some of the cylinders with fluid, the other cylinders continuing to be fed periodically with fluid, so that the motor operates at partial cubic capacity.

Thus, the invention is applicable both to a motor in which all of the cylinders belong to the first group and are thus suitable for all being made inactive, and also to a motor further comprising a second group of cylinders, which cylinders continue to be active when the cylinders of the first group are made inactive.

As indicated in FR 2 710 111, it is known that the pistons that are mounted to slide in the cylinders of the first group can be "declutched", an operation which consists in causing said pistons to cease to bear against the reaction member or "cam", thereby eliminating friction and premature wear. For that purpose, a "declutching" device makes it possible to maintain the pistons in question in the retracted configuration in which they are retracted inside their respective cylinders.

As also indicated in FR 2 710 111, the declutching operation and the "re-clutching" operation, which consists in putting the pistons back into abutment against the cam, are difficult and, unless certain precautions are taken, they can give rise to the pistons striking the cam violently.

To avoid such violent shocks, FR 2 710 111 recommends using selection means which comprise an individual selector for each of the cylinders of the first group, with the individual selector being controlled in such a manner that, to declutch or to clutch the piston slidably mounted in the cylinder with which it is associated, it can be activated during the relative rotation of the cylinder block and of the cam only while the axis of the cylinder is passing through a position in which it is adjacent to the crest of an undulation on the cam.

That system is quite satisfactory, but it is relatively costly because it requires the presence of as many individual selectors as there are cylinders in the first group. It also needs suitable control means for activating each of the individual selectors at precise times.

Document FR 2 677 409 discloses a hydraulic circuit making it possible to declutch the pistons of a hydraulic motor. That circuit includes a shuttle valve interposed on the ducts that connect the orifice of the pump to the inlet and outlet main orifices of the motor. That system is external, and it is mounted on the motor, which increases the overall size of the motor. In addition, the declutching is applied without exception to all of the pistons of the motor. Finally, the problems of shocks on declutching and on re-clutching are not avoided.

OBJECTS AND SUMMARY OF THE INVENTION

An object of the present invention is to provide a system that is simple and disposed inside the motor and that makes it possible to declutch the pistons slidably mounted in the cylinders of the first group, while substantially avoiding the phenomena of shocks between the pistons and the cam during declutching and re-clutching of the pistons in question, even at speeds of rotation that are relatively high, e.g. about 100 revolutions per minute (r.p.m.) and higher.

This object is achieved by the selection means comprising a single declutching selector constrained to rotate with the cylinder block about the axis of rotation and provided with a communication duct for each cylinder of the first group of cylinders, the selector being suitable for taking up a first position, corresponding to said first configuration, in which the communication ducts make it possible to connect the cylinder ducts of the cylinders of the first group to the distribution ducts, a second position corresponding to said declutching configuration, and an intermediate transitional position between said first and second positions, and in which the cylinder ducts of the cylinders of the first group are connected together via an isolated enclosure.

When the selector is in the first position, the cylinder ducts of the cylinders of the first group are normally connected to the distribution ducts and are thus alternately connected to the fluid inlet and to the fluid outlet, so that the pistons slidably mounted in said cylinders are active. When the declutching selector is in the second position, the cylinder ducts of the cylinders of the first group are all connected to the fluid discharge enclosure so that the pistons slidably mounted in said cylinders are inactive and can be retracted into said cylinders, i.e. they are declutched. Preferably, the fluid discharge enclosure is merely a portion of the inside space of the motor, which portion is connected to a leakage return duct.

When the selector is in the transitional position, the cylinder ducts of the cylinders of the first group are all connected together via an isolated enclosure. The term "isolated enclosure" is used to designate a portion of the inside space of the casing of the motor, which portion is isolated from the various "functional" ducts of the motor, i.e. the ducts that are connected to ducts external to the motor, such as an inlet duct or an outlet duct, or else an auxiliary duct connected to the booster circuit of the motor to perform an auxiliary function of the motor (braking control, etc.). In other words, the isolated enclosure is connected neither to the inlet nor to the outlet, nor to any auxiliary pressure external to the motor.

In this transitional position, the pistons of the cylinders of the first group can be displaced in their respective cylinders as a function of their positions on the cam. In other words, they are not locked in given positions inside their cylinders, but rather they can follow the undulations of the cam, the volumes of fluid displaced by the retraction or "inward" motion of certain pistons compensating for the volumes of fluid displaced by the outward motion of the other pistons, the motor being constant-velocity.

It is only after the selector has gone through its transitional position that the cylinders of the first group are connected to the fluid discharge enclosure. Thus, the invention makes it possible to avoid putting the fluid discharge enclosure in direct contact with the inlet or the outlet of the motor, which would prevent said motor from operating properly. However, during the displacement of the selector, the cylinder ducts of the cylinders of the first group are not isolated from one another, which avoids locking the pistons slidably mounted in the cylinders.

Advantageously, the declutching selector is formed by a slide mounted to slide in a bore in the cylinder block, the communication ducts comprising communication channels provided in the surface of the slide. The cylinder ducts of the cylinders of the first group have orifices that are open in said bore in the cylinder block, each of the orifices being continuously connected to a respective communication channel; and the bore in the cylinder block is provided with an intercommunication groove to which the communication channels are connected when the declutching selector is in the transitional position.

The communication channels are disposed axially or substantially axially at the surface of the slide. They are thus extremely simple to machine. When the selector is in the first position, the communication channels make it possible to connect the cylinder ducts of the cylinders of the first group with the distribution ducts, so that the pistons of the cylinders of the first group are active. By axially displacing the selector towards its second position, the connection between the distribution ducts and the cylinder ducts of the cylinders of the first group is caused to cease, and the communication channels are all connected to the intercommunication groove in the cylinder block.

The set comprising the cylinder ducts of the cylinders of the first group, the communication channels, and the intercommunication groove constitutes the isolated enclosure via which the cylinder ducts of the cylinders of the first group communicate with one another when the selector is in the transitional position.

In which case, advantageously, for each cylinder duct of the cylinders of the first group, the motor has a distribution passageway formed by a duct that has a first orifice open in the bore of the cylinder block and a second orifice open in a communication face of the cylinder block so as to be connected to the distribution ducts during the relative rotation of the cylinder block and of the distributor, and, for each cylinder duct of the cylinders of the first group, the first orifice of the duct forming the distribution passageway, the orifice of the cylinder duct and the intercommunication groove are successively disposed in the bore of the cylinder block in the direction in which the slide of the selector is displaced from its first position to its second position.

For each cylinder of the first group, the communication passageway is connected continuously to the communication face of the cylinder block and it can thus be connected alternately to each of the distribution ducts. For each cylinder duct of the cylinders of the first group, the communication channel establishes the communication between the cylinder duct and the distribution passageway, when the selector is in the first position. When the selector is displaced into its second position, the communication between the distribution passageway and the cylinder duct ceases, while said cylinder duct is connected to the intercommunication groove, also via the communication channel.

Advantageously, for causing the declutching selector to be displaced between its first and second positions, the motor further comprises control means which comprise resilient return means suitable for continuously urging said selector towards one of its first and second positions, and counter-force means suitable for being controlled so as urge the selector towards the other of its first and second positions.

In a variant, the resilient return means urge the selector towards its first position, and the counterforce means comprise a control piston co-operating with a control cylinder secured to a stator portion of the motor, said control piston being suitable for being displaced against the return force of said return means so as to urge the selector towards its second position.

The declutching of the pistons of the cylinders of the first group is then obtained by a positive command of the control piston, against the resilient return means, this command being, in particular, hydraulic.

It is possible to make provision for the control piston to co-operate with the selector via spherical abutment means, or via ball or roller bearing means, or via hydrostatic abutment means using a confined fluid.

The control cylinder is secured to a stator portion of the motor, while the selector is constrained to rotate with the cylinder block. Therefore, that portion of the selector with which the control piston co-operates rotates relative to the control cylinder. The choice of spherical abutment means, of ball or roller means, or of hydrostatic abutment means makes it possible to avoid premature wear of the parts that rotate relative to one another. In particular, choosing spherical abutment means makes it possible to limit the friction between the control piston and the selector to a zone of small area. This zone is preferably aligned with the axis of rotation of the motor, both the cylinder block bore in which the declutching selector is disposed, and also the control cylinder preferably being centered on the axis of the motor. Thus, the relative speed between the stationary part and the rotary part is low, so that, at the most, very low torque is generated in this zone. As a result, the friction, and thus the heating of the parts in contact are limited.

Choosing the ball abutment means makes it possible substantially to eliminate the friction by replacing it with a rolling contact, thereby also avoiding risks of friction and thus of premature wear.

When hydrostatic abutment means are chosen, the contact friction is also eliminated and is replaced by fluid friction, which offers substantially the same advantages.

In another variant, the counter-force means comprise a control chamber provided between the selector and a reference part fixed relative to the cylinder block, and a control duct suitable for connecting said control chamber to a fluid source.

It is possible to make provision for the resilient return means to urge the selector towards its second position, and for the counter-force means to be suitable for being controlled to urge the selector towards its first position.

In which case, the declutching configuration is obtained at rest, by the resilient return means. This is advantageous, for example, when the motor serves to drive a vehicle. If a fault in controlling the counter-force means occurs while the vehicle is being driven with the pistons in the clutched position (thus at low speed and at high motor torque), this fault causes the selector to go into the declutched configuration, thereby reducing the cubic capacity and thus the torque of the motor. The driver then has no difficulty in controlling the speed by controlling the flow rate of the pump.

This variant is also advantageous in a hydraulic motor equipped with a parking and safety brake. In which case, if a user tries to start the hydraulic motor without having released the braking, the braking torque necessary to prevent untimely driving of the motor and of the vehicle equipped with the motor must merely be capable of overcoming the torque developed by the motor in its declutched configuration (i.e. at low cubic capacity) which is the rest configuration. This braking torque is less than the torque that would be necessary if the rest position of the selector were its first position (in which the pistons are clutched), which makes it possible to choose a brake that is more compact and less costly.

In an advantageous layout, a decompression chamber is provided at that end of the declutching selector which is situated on the downstream side thereof in the direction in which it is displaced from its first position to its second position, and, when said selector is in its second position, the cylinder ducts are connected to said chamber.

When the selector goes from its first position to its second position, the decompression chamber is fed with the fluid that is situated in the cylinder ducts of the cylinders of the first group. The decompression chamber is thus "put under pressure", thereby applying a force opposing the continued displacement of the selector towards its second position. In other words, the displacement of the selector between its transitional position and its second position is slowed down, so that the declutching takes place smoothly.

This decompression chamber is advantageously in communication with a leakage return duct connected to a pressure-free tank. This communication advantageously takes place via at least one passageway of small cross-section, thereby causing a head loss between the decompression chamber and the leakage return duct, which head loss makes it possible to prevent the selector from being displaced too quickly from its first position to its second position.

The size of the through cross-section of the passageway(s) of the small cross-section determines the head loss between the decompression chamber and the leakage return duct, thereby conditioning the speed of displacement of the selector between its transitional position and its second position.

The invention is applicable to motors in which all of the pistons are to be declutchable. It is also applicable to motors that each have at least two distinct operating cubic capacities and in which only the pistons of those cylinders which are inactive at low cubic capacity(ies) are to be declutched.

In which case, advantageously, the cylinder block has a second group of cylinders disposed radially relative to the axis of rotation, each cylinder of the second group being connected to a respective cylinder duct which is connected directly to a communication face of the cylinder block, which face co-operates with a distribution face of the distributor, so as to be connected to the distribution ducts during the relative rotation of the cylinder block and of the distributor, independently of the position of the declutching selector.

Thus, when the pistons slidably mounted in the cylinders of the first group are declutched, those which are slidably mounted in the cylinders of the second group can, insofar as said cylinders continue to be connected to the distribution ducts, continue to be active to deliver a low motor torque. In which case, the motor operates at a low cubic capacity, whereas, when the selector is in its first position, all of the cylinder ducts are connected to the distribution ducts, and it operates at a high cubic capacity.

It should be noted that, in addition to the selector for declutching the pistons, it is possible to provide an additional cubic capacity selector that acts on the connection between the cylinder ducts and the distribution ducts. This cubic capacity selector may be controlled independently of the declutching selector so as to be caused to go between two positions corresponding respectively to a higher cubic capacity and to a lower cubic capacity. It is thus possible to obtain four distinct operating cubic capacities depending on whether the selectors are simultaneously in their first positions or in their second positions, or whether one is in its first position while the other is in its second position.

BRIEF DESCRIPTION OF THE DRAWINGS

The invention will be well understood and its advantages will appear more clearly on reading the following detailed description of embodiments given by way of non-limiting example.

The description refers to the accompanying drawings, in which.

MORE DETAILED DESCRIPTION

Figure 1:
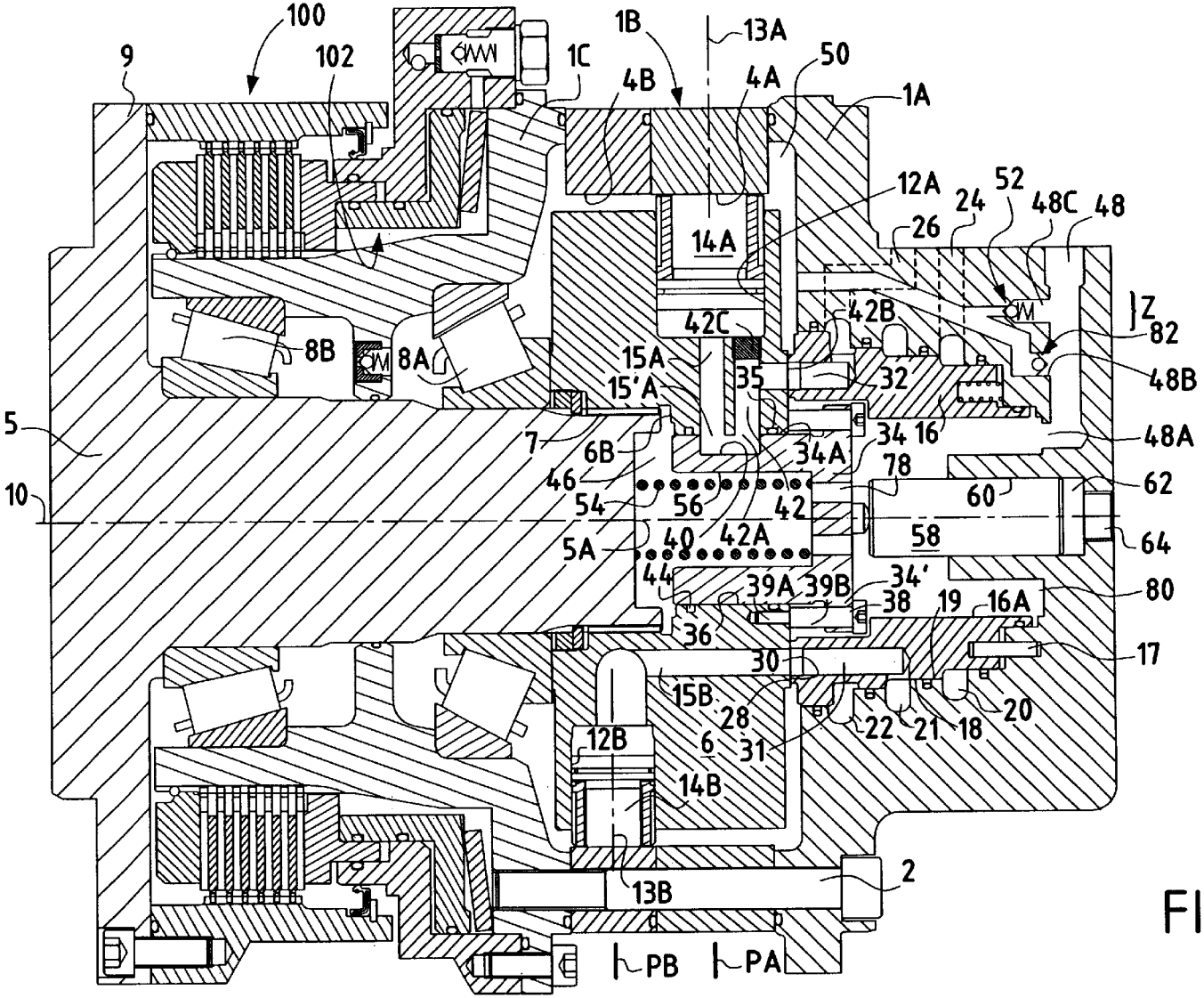
FIG. 1 is an axial section view of a radial-piston hydraulic motor of the invention.

FIG. 1 shows a hydraulic motor having radial pistons and a stationary casing. However, the invention is also applicable to motors having rotary casings. The casing is made up of a plurality of portions, namely, a first portion 1A referred to as the "distribution cover", a second portion 1B whose inside periphery is undulating so as to form a reaction cam, and a portion 1C. The various portions are assembled together by screws 2.

In the example shown, the undulating cam is itself made up of two portions 4A and 4B that are juxtaposed axially.

The motor includes a cylinder block 6 which is mounted to rotate relative to the cam about an axis of rotation 10 and which is provided with a plurality of radial cylinders inside which radial pistons are slidably mounted.

There are two groups of cylinders, namely a first group of cylinders 12A and a second group of cylinders 12B. The axes 13A of the cylinders 12A (which axes are disposed radially relative to the axis of rotation 10) define a first radial plane PA, while the axes 13B of the cylinders of the second group 12B define a second radial plane PB distinct from the plane PA. The pistons 14A that slide in the cylinders 12A of the first group co-operate with the first portion 4A of the cam, while the pistons 14B that slide in the cylinders 12B of the second group co-operate with the second portion 4B of the cam.

The cylinder block 6 rotates a shaft 5 which co-operates with it via fluting 7. That end of the shaft 5 which is opposite from the cover of the distributor 1A carries an outlet flange 9. The shaft 5 is supported relative to the portion 1C of the casing by bearing means, e.g. conical roller bearings 8A and 8B.

The motor further includes an internal fluid distributor 16 which, by means of a stud-and-notch system 17, is prevented from rotating relative to the distribution cover 1A.

The distributor 16 has a stepped external axial face 18 co-operating with a stepped inside axial face 19 of the distribution cover 1A. Between the faces 18 and 19, three grooves are provided, respectively designated by the references 20, 21, and 22.

The motor further includes two main ducts, namely an inlet main duct and an outlet main duct. These main ducts do not lie in the section plane of FIG. 1 but, to facilitate understanding, their positions are indicated by dashed lines. Thus the first main duct 24 is continuously connected to the first groove 20, while the second main duct 26 is connected continuously to the third groove 22. As explained below, the second groove 21 can be connected to one or the other of the grooves 20 and 22 depending on the position of a cubic capacity selector not shown in FIG. 1.

However, the invention is also applicable both to a motor having the group 12A as a sole group of cylinders, and also to a motor for which only two distribution grooves are provided between the distributor and the distribution cover, which grooves are continuously connected to respective ones of the main ducts.

Distribution ducts are provided in the distributor, and they open out in a radial distribution face 28 thereof, which face bears against a radial communication face 30 of the cylinder block. The distribution ducts selectively connect the grooves 20, 21, and 22 to the distribution face. In the example shown, the only ducts shown are a distribution duct 31 that connects the groove 21 to the distribution face 28, and a distribution duct 32 that connects the groove 22 to the distribution face. Each cylinder is associated with a cylinder duct, which makes it possible to connect it to the communication face 30 of the cylinder block, so as to put it in communication alternately with each of the distribution ducts while the cylinder block is rotating relative to the cam.

Thus, for each cylinder 12B of the second group of cylinders, a cylinder duct 15B puts said cylinder directly in communication with the communication face 30. Whereas, for the cylinder 12A of the first group, the cylinder ducts 15A are put in communication with the communication face 30 via a declutching selector 34.

The selector 34 is formed by a slide mounted to move axially in a central bore 36 of the cylinder block. The selector is constrained to rotate with the cylinder block about the axis 10. It has a flange portion 34' provided with holes through which the rods of screws 38 pass. Each of these rods has a threaded end portion 39A screwed into a tapped hole in the cylinder block, and a smooth intermediate portion 39B with which the hole in the flange 34' co-operates and through which the rod in question is engaged. Thus, the selector 34 can slide relative to the screws 38.

The outside cylindrical face 34A of the selector 34 co-operating with the bore 36 of the cylinder block has as many communication ducts in the form of channels 40 as the first group of cylinders has cylinders, each channel 40 being associated with a respective cylinder duct 15A.

Each cylinder duct 15A has an end connected to the cylinder 12A and another end forming an orifice 15'A that is open in a bore 36 of the cylinder block. This orifice 15'A is continuously in communication with the communication channel 40 associated with the cylinder duct 15A in question.

Each cylinder duct 15A is associated with a distribution passageway formed by a duct 42 that has a first orifice 42A open in the bore 36 of the cylinder block, and a second orifice 42B open on the communication face 30 of the cylinder block. As can be seen in FIG. 1, this makes it possible to connect the distribution passageway 42 to the distribution ducts such as the duct 32.

Both the cylinder duct 15A and the distribution passageway 42 thus open out in the bore 36 and, as can be seen in FIG. 1, this makes it possible to cause the cylinder duct 15A to communicate with the distribution ducts when the selector 34 takes up its first position. In axial section, the set comprising the duct 15A, the communication channel 40, and the distribution passageway 42 forms a substantially U-shaped duct connected to the communication face 30 of the cylinder block. The communication channel 40 extends substantially axially and its length is sufficient to interconnect the orifices 15'A and 42A when the selector is in the first position. That end of the distribution passageway 42 which is closer to the cylinder 12A is closed by a stopper 42C.

An intercommunication annular groove 44 is provided in the bore 36 of the cylinder block 6. As a function of the displacement of the selector, this groove 44 can be put in communication with the communication channels 40. As considered in the direction in which the selector is displaced from its first position to its second position, the orifice 42A, the orifice 15'A, and the groove 44 are disposed one after the other.

It is possible to dispose a sealing gasket 35 between said cylindrical face 34A and the bore 36, in that portion of said bore which is situated between the orifice 42A and the communication face 30. For example, this gasket is placed in a groove provided in the bore 36. Its purpose is to prevent leakage that could occur between the communication channels 40 and a space 80 of the motor that, as explained below, is connected to a leakage return duct 48.

The motor of FIG. 1 further includes a braking system 100 comprising two series of brake disks constrained to rotate respectively with the rotor and with the stator, and a brake piston 102 controlled to move between a braking configuration, in which it presses the disks against one another, and a brake release configuration.

Figure 2A:
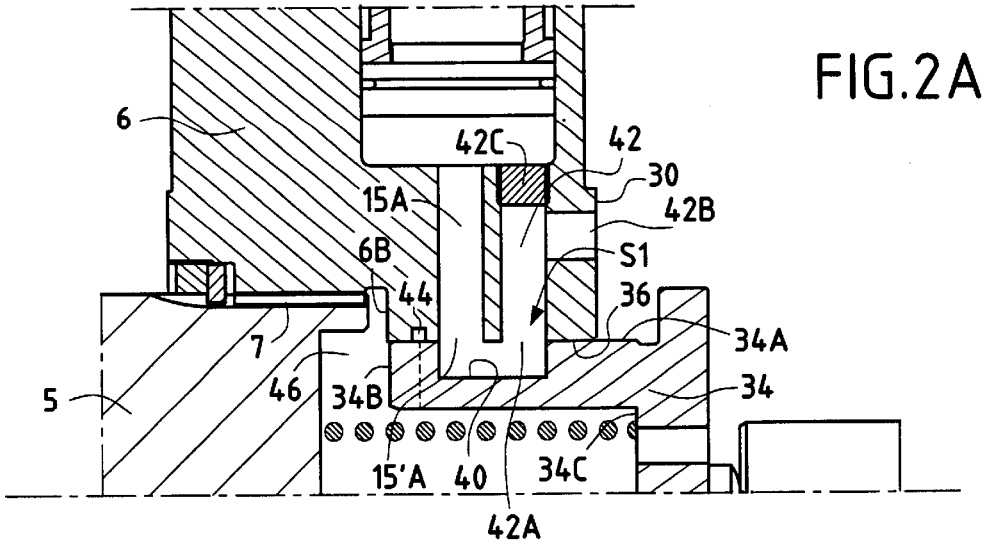
FIGS. 2A, 2B, 2C, and 2D are fragmentary axial section views showing the various stages of displacing the selector from its first position to its second position.

With reference to FIGS. 2A to 2D and to FIGS. 3A to 3D, the displacement of the selector 34 is described below. FIG. 2A is a fragmentary axial section view showing the slide of the selector 34 in its first position, the orifices 15'A and 42A of the cylinder duct 15A and of the distribution passageway 42 in question being interconnected via the communication channel 40.

Figure 3A:
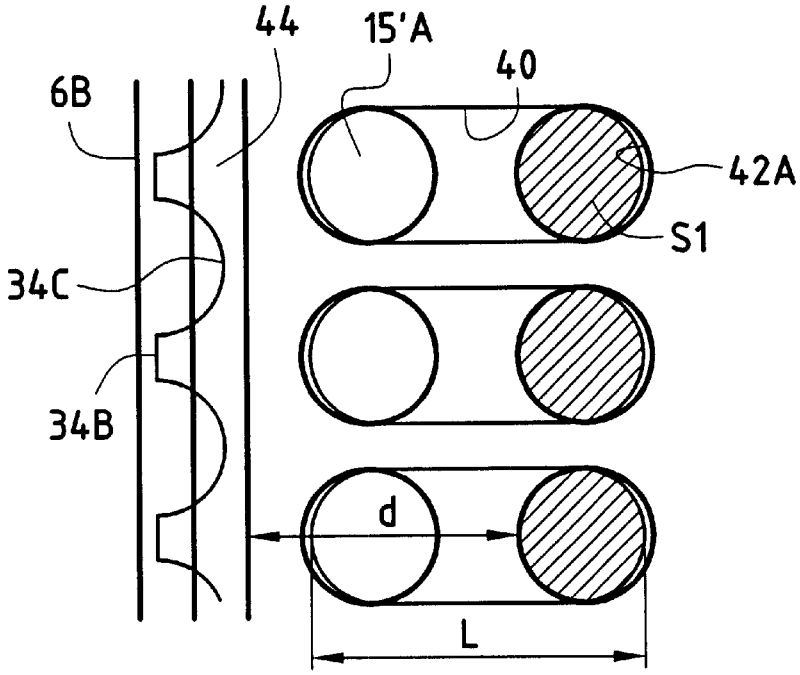
FIGS. 3A, 3B, 3C, and 3D are fragmentary developed views of the cylinder block bore containing the selector, and of the cylindrical face of the slide of the selector, respectively for the positions shown in FIGS. 2A, 2B, 2C, and 2D.

FIG. 3A shows, in bold lines, a portion of the development of the bore 36 and, in fine lines, a corresponding portion of the development of the outside cylindrical face 34A of the slide 34. It is thus possible, for a plurality of juxtaposed cylinders, to see the orifice 15'A of the cylinder duct 15A and the first orifice 42A of the distribution passageway 42. It is also possible to see the position of the intercommunication groove 44. The communication channels 40 associated with respective ones of the cylinder ducts taken into account in FIG. 3A are shown in fine lines.

It is also possible to see that the end face 34B of the slide 34 that is adjacent to the groove 44 is provided with axial notches 34C. As can be seen in FIG. 3A, these notches make it possible, even when the selector 34 is in its first position, to put the intercommunication groove 44 in communication with a decompression chamber 46 that is described below.

In FIGS. 2A and 3A, the orifices 15'A and 42A thus communicate with the communication channel 40, but they are isolated from the groove 44. The communication between the distribution passageway 42 and the communication channel 40 is then provided via a maximum cross-section S1.

Figure 2B:
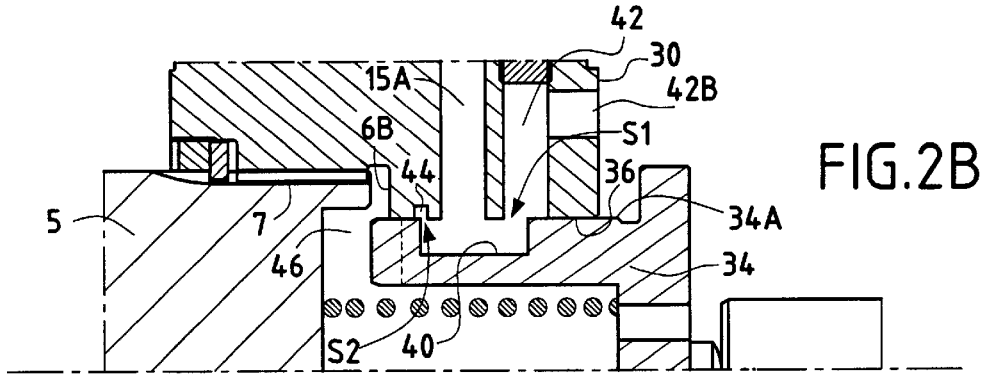
Figure 3B:
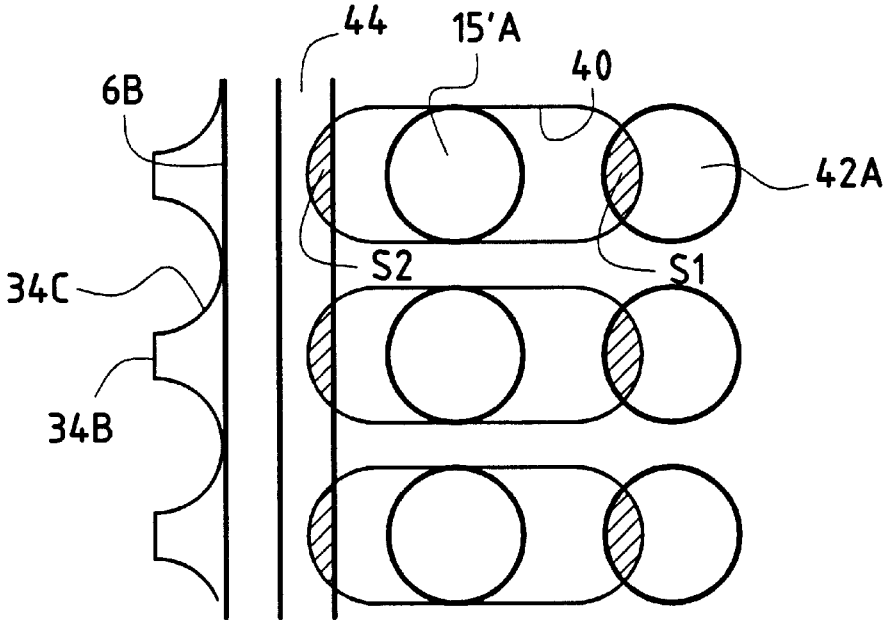

In FIGS. 2B and 3B, the slide 34 has started its displacement towards its second position. In this situation, the orifice 42A of the distribution passageway 42 communicates with the communication channel 40 only via a cross-section Si that is smaller, while the communication channel 40 starts to communicate with the groove 44 via a cross-section S2. At this time, the cylinders of the first group continue to be connected to the distribution ducts of the distributor, but via the cross-section S1 only. As a result, the pistons of these cylinders contribute to a small extent only to the motor torque.

Figure 2C:
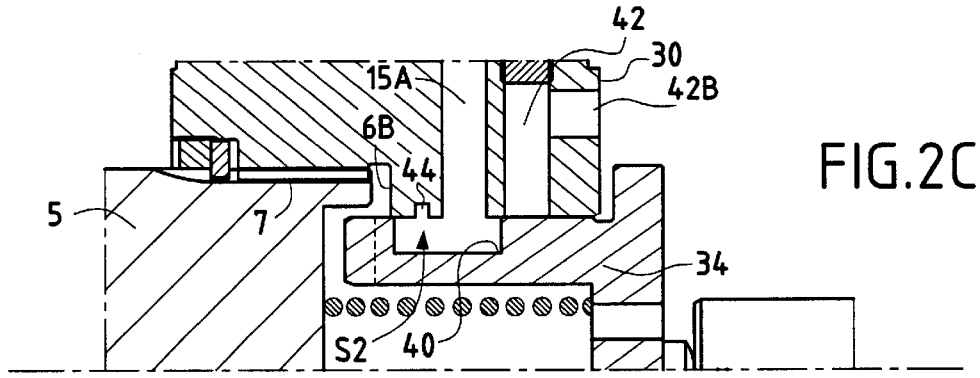
Figure 3C:
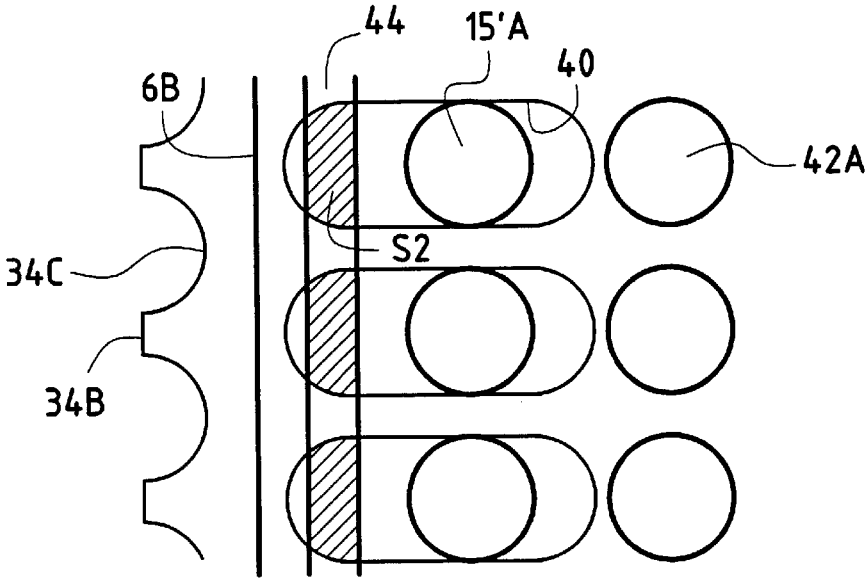

FIGS. 2C and 3C show the slide 34 in its transitional position, and it can be observed that the communication between the orifice 42A and the communication channel 40 has completely ceased (S1=0), while the communication between said channel 40 and the groove 44 is provided via the cross-section S2 which is almost at its maximum. However, in this situation, the communication channel 40 has not yet gone beyond the face 6B of the cylinder block, so that it is not yet communicating with the decompression chamber 46. Thus, in this transitional situation, the set comprising the cylinder ducts 15A of the cylinders of the first group 12A together with the set comprising the communication channels 40 and the groove 44 constitute a closed enclosure that is isolated, in particular from the inlet and outlet ducts or from any ducts conveying an auxiliary control pressure. The positions of the cylinders of the first group can however be displaced as a function of their positions relative to the cam, without being locked, because the cylinder ducts of the first group are not closed, but rather they are all put in communication with the above-mentioned enclosure.

Figure 2D:
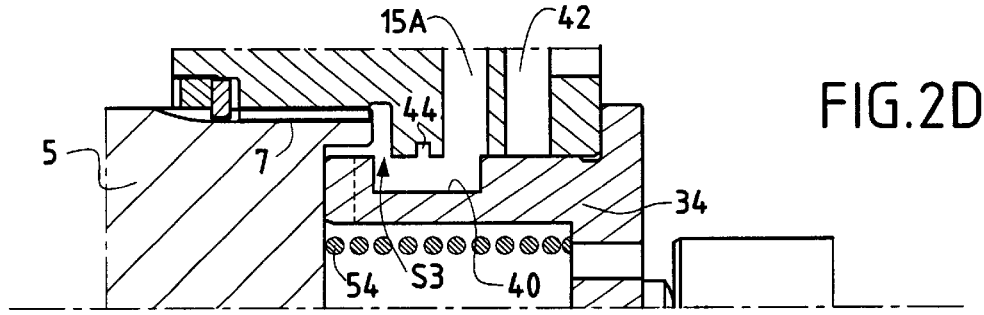
Figure 3D:
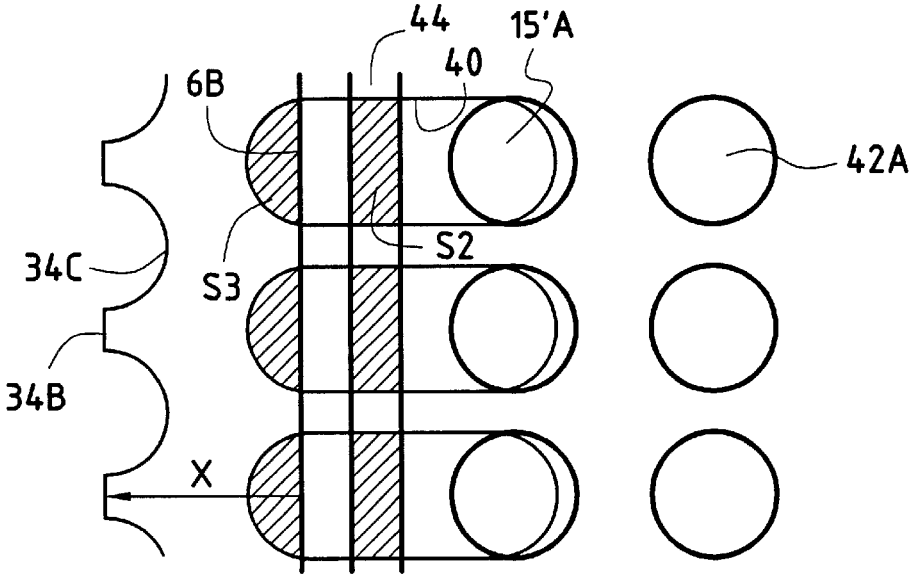

In FIGS. 2D and 3D, the slide 34 has reached its second position, and it can be seen that the orifices 15'A of the cylinder ducts of the cylinders of the first group continue to communicate with the communication channels 40, which themselves continue to communicate with the groove 44 and which, above all, project beyond the face 6B of the cylinder bloc so as to communicate, via a crosss-section S3 with the decompression chamber 46, which is itself connected to a leakage return duct 48 which, in a manner known per se, is connected to a pressure tank.

It should be noted that this decompression chamber constitutes an advantageous variant, but that provision must also be made, when the selector is in the second position, to cause the communication channels 40 to communicate directly with a leakage return duct, or more generally with a fluid discharge enclosure.

Figure 4:
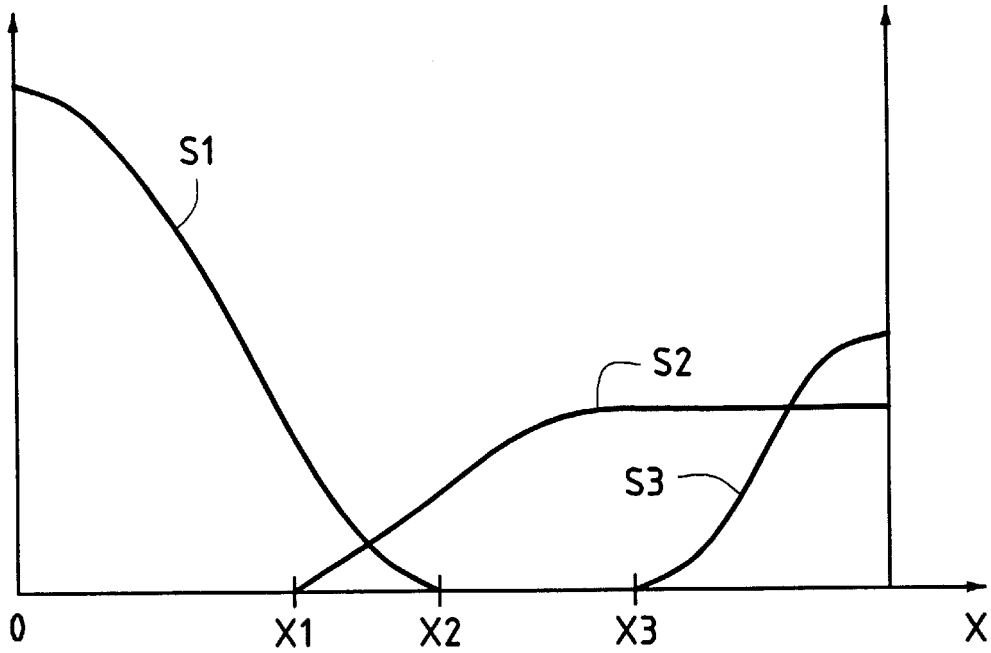
FIG. 4 is a graph showing the variation of the communication cross-sections between the cylinder ducts of the cylinders of the first group, the communication channels, and the intercommunication groove, as a function of the displacement of the slide of the selector.

The graph in FIG. 4 shows how the cross-sections S1, S2 and S3 vary during the displacement of the slide 34 from its first position (displacement 0) to its second position (displacement X). It can be seen that the through cross-section S1 decreases uniformly to become zero for a displacement X2. The cross-section S2 starts to take a non-zero value as from a displacement X1 that is less than the displacement X2. FIGS. 2B and 3B correspond to an intermediate displacement value between the values X1 and X2. Then, when the displacement continues, the cross-section S2 continues to increase, and the cross-section S3 starts to take a non-zero value as from a displacement X3 that is greater than the displacement X2.

As measured in the direction in which the selector 34 is displaced, the minimum distance d (see FIG. 3A) between the first orifice 42A of the duct forming the distribution passageway 42 associated with a given cylinder duct 15A and the intercommunication groove 44 is less than the length L of the communication channel 40 associated with said cylinder duct. This makes it possible to obtain the situation shown in FIGS. 2B and 3B.

When the selector 34 takes up its second position, the cylinder ducts 15A are thus connected to a fluid discharge enclosure, optionally via the decompression chamber 46. As a result, the pistons of the cylinders of the first group cease to be urged in the direction tending to move them away from the axis of rotation 10 of the motor. The motor includes means that, in this situation, cause the pistons to be retracted into their respective cylinders, i.e. bring them back towards the axis of rotation 10. Whereupon the pistons are declutched and they cease to co-operate with the cam.

To declutch the pistons, it is possible to provide special means, such as springs that tend to return the pistons into their cylinders. However, the crests of the lobes of the cam acting on the pistons can suffice to return said pistons into their cylinders.

In order to ensure that, while the cylinder block is rotating, the declutched pistons do not tend to come back out of their cylinders and back into contact with the troughs of the cam, provision is advantageously made to cause a certain pressure to prevail in that region 50 of the space around the motor in which the cam 4A is situated. It is known that this inside space can be connected to a leakage return duct such as the duct 48. Advantageously, to obtain the above-mentioned pressure, the invention makes provision to enable such connection to be obtained only via a calibrated valve 52 situated in a link duct between the space 50 and the leakage return duct 48. For example, for rotation speeds lying in the range 100 r.p.m. to 400 r.p.m., calibrating the valve 52 to pressures of about 1 bar to 2 bars suffices to ensure that the pressure prevailing in the space 50 prevents any displacement of the pistons towards the outside of their respective cylinders under the effect of the centrifugal forces generated by the rotation of the cylinder block when said cylinder block continues to be rotated by the active pistons of the second group.

With reference to FIGS. 1 and 5A to 5C, a first variant of control means is described for causing the selector 34 to be displaced between its first and second positions. The selector 34 is disposed in the bore 36 in the cylinder block, and it is preferably coaxial with the axis of rotation 10. Control means for controlling its displacement comprise resilient return means such as a spring 54 suitable for urging the selector 34 continuously towards its first position. In the example shown, this spring 54 bears firstly against that radial face 5A of the shaft 5 which is situated closer to the distributor 16, and secondly against that radial face 34C of the slide which is opposite from said radial face 5A. The spring 54 is received in part in a central recess 56 in the slide 34, an end portion of said recesss forming said surface 34C.

The control means for controlling the displacement of the selector 34 further comprise a control piston 58 co-operating with a control cylinder 60 that is secured to a stator portion of the motor, namely the distribution cover 1A in this example. A control chamber 62 suitable for being connected to a hydraulic control duct via an orifice 64 is provided at that end of the piston 58 which is opposite from the selector 34. Under the effect of fluid being fed to said chamber 62, the piston is thus suitable for being displaced against the return force of the spring 54 to urge the selector 34 towards its second position.

The cylinder 60 is provided in the stator of the motor, and the piston 58 is also prevented from rotating about the axis 10. The selector 34 is constrained to rotate with the cylinder block. As a result, when the motor has a stationary casing, the contact between the piston 58 and the selector 34 takes place via surfaces rotating relative to each other. It should be noted that these surfaces are subjected to high stresses only when the selector is displaced towards its second position under the action of the piston 58.

Figure 5A:
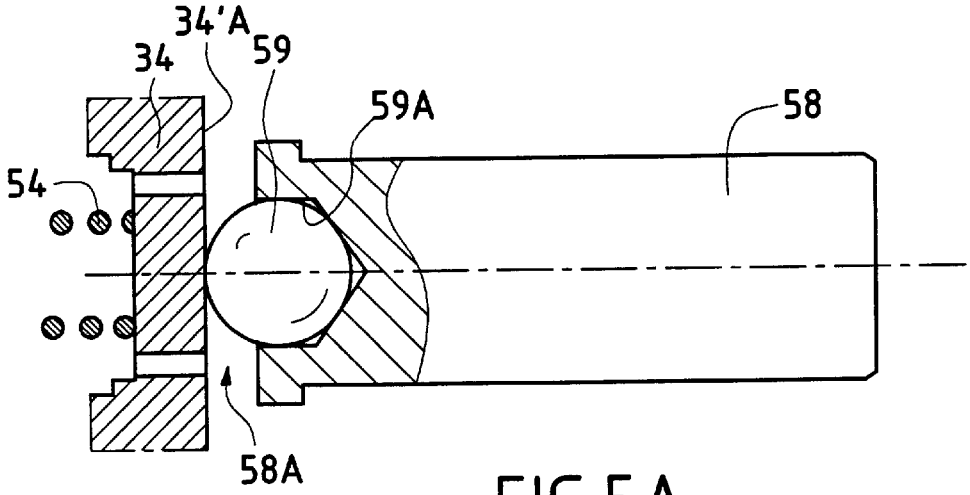
FIGS. 5A, 5B, and 5C show three implementations of the co-operation between the declutching selector and the control piston of the control means of the selector.
Figure 5B:
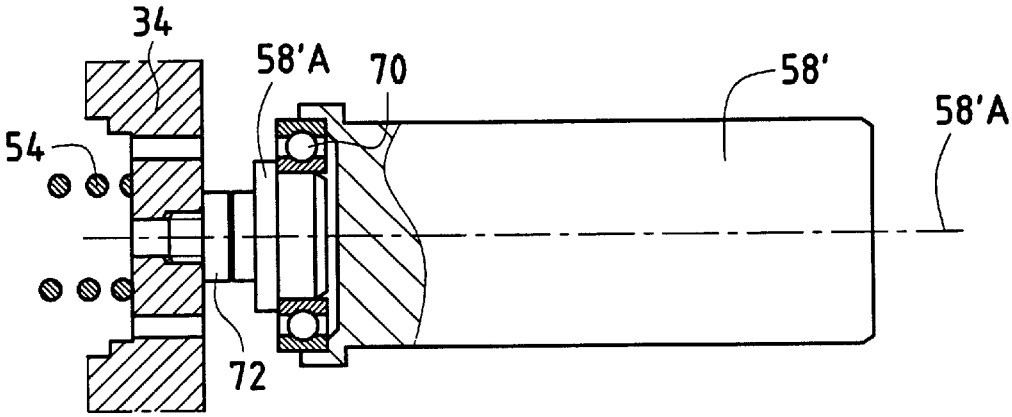

FIGS. 5A and 5B show various variant embodiments of the contact zones of the selector piston, organized to limit any premature wear that might nevertheless result from the relative rotation.

Thus, in FIG. 5A, the active head 58A of the piston 58, i.e. that portion of the piston which co-operates with the selector 34, is equipped with spherical abutment means. In the example shown, they are constituted by a ball 59 crimped in a recess 59A provided in the end of the piston. For example, the ball co-operates directly with the facing radial face 34'A of the selector. The ball 59 may be replaced by a screw or the like whose head has a surface constituting a sphere portion. It is also possible to make provision for the spherical surface to be formed on the face 34'A of the selector.

In FIG. 5B, the control piston 58' is provided with an active head 58'A which is connected to the body of the piston by bearing means 70. For example, as shown, the head 58'A co-operates with the selector 34 via a contact part 72 formed, for example, by the head of a screw screwed into the selector 34. The head 58'A and the part 72 may have hardness that is greater than the hardness of the other parts and/or a coating suitable for limiting friction.

Figure 5C:
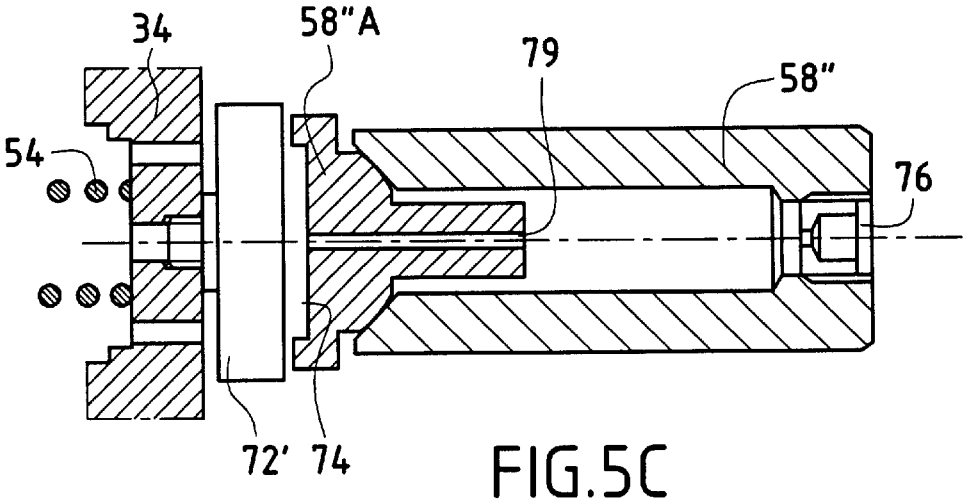

In FIG. 5C, the control piston 58" co-operates with the selector 34 via hydrostatic abutment using a confined fluid. Thus, the active head 58"A of the recessed piston 58" is formed by an additional part held in position relative to the piston by the fluid pressure prevailing in a hydrostatic abutment enclosure 74. This enclosure is connected to the above-mentioned control chamber 62 via a passageway having a restriction 76 formed at that end of the recessed piston 58" which is opposite from the head 58"A and via a hole 79 provided through the head 58"A and connecting the enclosure 74 to the recess in the piston 58". As in FIG. 5B, the head 58"A co-operates with the selector 34 via an additional contact part 72' fixed to said selector.

The decompression chamber 46 is provided at that end 34B of the selector which is at the downstream end thereof in the direction in which it is displaced from its first position to its second position. This chamber is thus provided between the selector 34, the cylinder block 6 and the shaft 5A, the links between the parts being made substantially fluid-tight. When the selector 34 is in the second position, the cylinder ducts 15'A of the cylinders of the first group are connected to this decompression chamber.

More precisely, as indicated above, the communication channels 40 are in communication with the chamber 46 when the selector is in its second position. Thus, when, during displacement of the selector from its first position to its second position, the cylinder ducts 15'A start to be put in communication with the chamber 46, said chamber finds itself fed with the fluid contained in the ducts. As a result, the fluid pressure in the chamber 46 increases, and said pressure applies an opposing hydraulic force that opposes displacement by the piston 58. Thus, as from this establishment of communication between the ducts 15'A and the chamber 46, the displacement of the selector 34 towards its second position is slowed down, so that the cross-section S3 increases very gradually and the pistons of the cylinders of the first group are declutched "gently".

The decompression chamber 46 is in communication with the above-mentioned leakage return duct 48. Advantageously, this communication is established via at least one passageway of small cross-section. The phrase "passageway of small cross-section" is used to designate a passageway through which the fluid flow rate is relatively low, so as to cause a pressure difference (head loss) between the chamber 46 and the leakage return duct 48.

These provisions make it possible to connect the cylinder ducts 15'A to the leakage return duct 48 when the selector is in the second position, while slowing down the displacement of the selector as from the moment when the cross-section S3 has become non-zero. Advantageously, the passageways of small cross-section are formed by holes 78 passing axially through the selector 34.

When, as is the example shown, the ends of the holes are situated in the abutment zone in which the spring 54 abuts against the end wall of the recess 56, they can be machined without any particular precaution being taken as regards their cross-section, and it is the presence of the springs that reduces their through cross-section. At their ends opposite from the spring 54, the passageways 78 open out in a space 80 of the motor, which space is provided between the piston 58 and an internal bore 16A of the distributor, and is connected to the leakage return duct 48.

The decompression chamber 46 is in communication with the inside space 50 of the motor that is situated under the reaction member 4A via a non-return valve 82 which allows fluid to flow only in the direction in which the chamber is emptied. Thus, a portion of the volume expelled from the cylinder ducts 15'A during the declutching stage can be injected into the space 50 of the casing to compensate the variation in volume due to the declutched pistons retracting. In addition, because of the presence of the above-mentioned calibrated spring 52, sufficient pressure prevails in the space 50.

More precisely, the leakage return duct 48 comprises a first segment 48A which is connected to the space 80, and thus, via the passageways 78, to the decompression chamber 46, a second segment 48B in which a non-return valve 82 is situated, and a third segment 48C in which the calibrated valve 52 is situated. When the pressure in the space 50 is greater than the calibration pressure of said calibrated valve, said valve allows the fluid to flow only in the direction going from the space 50 towards the duct 48.

In addition to the cylinders 12A of the first group, the motor includes cylinders 12B which belong to a second group and in which pistons 14B are slidably mounted. The cylinder ducts 15B of the cylinders 14B open out in the communication face 30 of the cylinder block 6 so as to be put in communication alternately with the distribution ducts such as the ducts 31 and 32, while the cylinder block and the distributor are rotating relative to each other.

Figure 6:
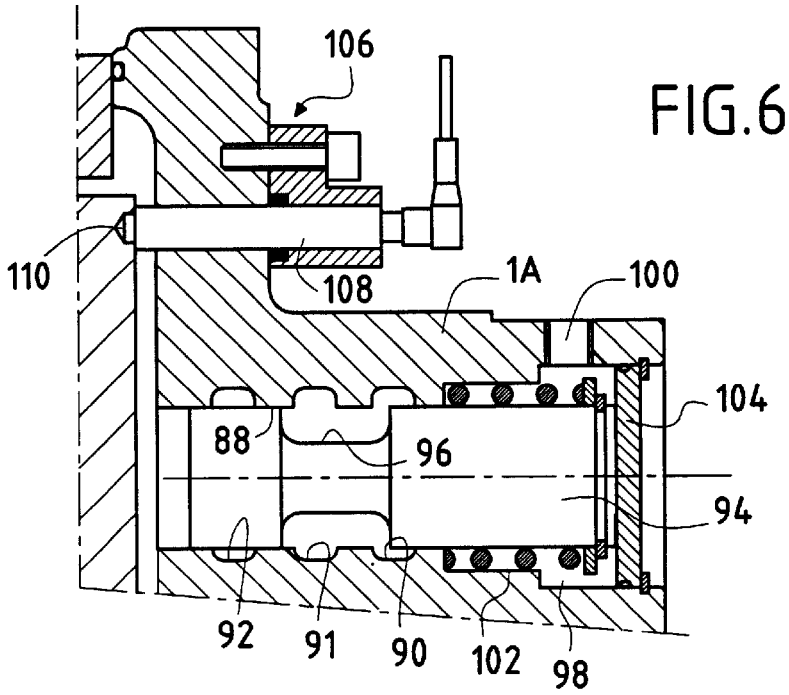
FIG. 6 is a fragmentary section view showing the presence of a cubic capacity selector in addition to the declutching selector.

Advantageously, as shown in FIG. 6, the motor includes a cubic capacity selection device distinct from the selector 34. This device is situated in the distribution cover 1A, in the zone Z indicated in FIG. 1, but it is not shown in FIG. 1 insofar as it is not in the section plane of FIG. 1.

Unlike the selector 34, the cubic capacity selection device does not co-operate with the cylinder ducts, but rather it co-operates with the distribution grooves 20, 21, and 22. It has an axial bore 88 in which three grooves 90, 91, and 92 are provided which are continuously in communication with respective ones of the three distribution grooves 20, 21, and 22. A slide 94 is mounted to move inside the bore 88, and it is provided with an analogous groove 96. When the slide is in a first position, the groove 96 causes the grooves 90 and 91 to communicate (it therefore also causes the grooves 20 and 21 to communicate), while, when the slide is in the second position, its groove 96 causes the grooves 91 and 92 to communicate (and thus also causes the grooves 21 and 22 to communicate.

The distribution ducts are organized in three groups connected to respective ones of the three grooves 20, 21, and 22. For example, the number of ducts in the third group, which ducts are connected to the groove 22, is equal to the sum of the number of ducts in the first group and of the number of ducts in the second group.

For example, the first position of the slide 94 shown in FIG. 6 is a high cubic capacity position, in which the ducts of the first and second groups are connected to the main duct 24 and isolated from the ducts of the third group, while the ducts of the third group are connected to the main duct 26 and isolated from the ducts of the other two groups. While the cylinder block is rotating, the cylinder ducts 15B and the ends 42B of the distribution passageways 42 alternately face a distribution duct belonging to the third group, and then a distribution duct belonging to one of the first and second groups. Thus, when the selector 34 is in its first position, then, during the rotation of the cylinder block, all of the cylinders are connected to the fluid inlet via the duct 24 or 26 and then to the fluid outlet via the other of these ducts. All of the cylinders of the motor are thus active, and the motor operates at high cubic capacity.

When the selector 34 is in its second position, while the slide 94 is in its first position, the pistons of the cylinders of the first group are declutched. However, during the rotation of the cylinder block, the orifices of the cylinder ducts 15B of the cylinders of the second group continue to be put in communication alternately with a distribution duct connected to the fluid inlet then with a distribution duct connected to the fluid outlet, so that the pistons of the cylinders of the second group are active. The motor then operates at a partial cubic capacity, equal to the total cubic capacity of all the cylinders of the second group.

When the slide 94 is in the second position, the groove 90 is isolated, whereas the grooves 91 and 92 communicate with each other. Thus, of the distribution ducts, only those of the first group which are connected to the groove 20 continue to be connected to the main duct 24. In contrast, all of the distribution ducts of the second and third groups are connected to the main duct 26 by means of the communication established between the grooves 91 and 92. Therefore, only those cam lobes which correspond to the distribution ducts 20 of the first group are active, since the pistons which, at any given time, co-operate with these cam lobes, are alternately connected to a distribution duct of the first group that is connected to the groove 20, and then to a distribution duct of the second or third groups, which duct is connected to the main duct 26.

Thus, when the selector 34 is in its first position while the slide 94 is in its second position, all of the pistons of the motor that go past and face those lobes of the cams 4A and 4B which, as a function of their positions relative to the distribution ducts, are active, contribute to the motor torque. The motor is then operating at another partial cubic capacity, corresponding to the cubic capacity of these active cylinders.

In contrast, when the selector 34 is in its second position, and when the slide 94 is also in its second position, the pistons of the cylinders of the first group are declutched. Therefore, even when the pistons go past the region of the active cam lobes, they naturally do not contribute to the motor torque. In which case, the motor is operate at a low cubic capacity, its cubic capacity being given by the cylinders of the second group whose pistons co-operate with those cam lobes which, as a function of their positions relative to the distribution ducts, are active.

Thus, by means of the presence of the selector 94, the motor has four distinct operating cubic capacities.

The slide 94 is caused to be displaced between its two positions by control means comprising a control chamber 98 suitable for being connected to a control duct via an orifice 100, and a spring 102 opposing an increase in the volume of the chamber. On the side opposite from the cylinder block 6, the chamber 98 is delimited by a closure washer 104 mounted in the bore 88.

It should also be noted, in FIG. 5, that the motor of the invention may by provided with a tachometer 106 comprising a sensor 108 which counts the number of times markers 110 go past its ends, which markers are provided at regular intervals on the radial face of the cylinder block situated closer to the distribution cover 1A.

Figure 7:
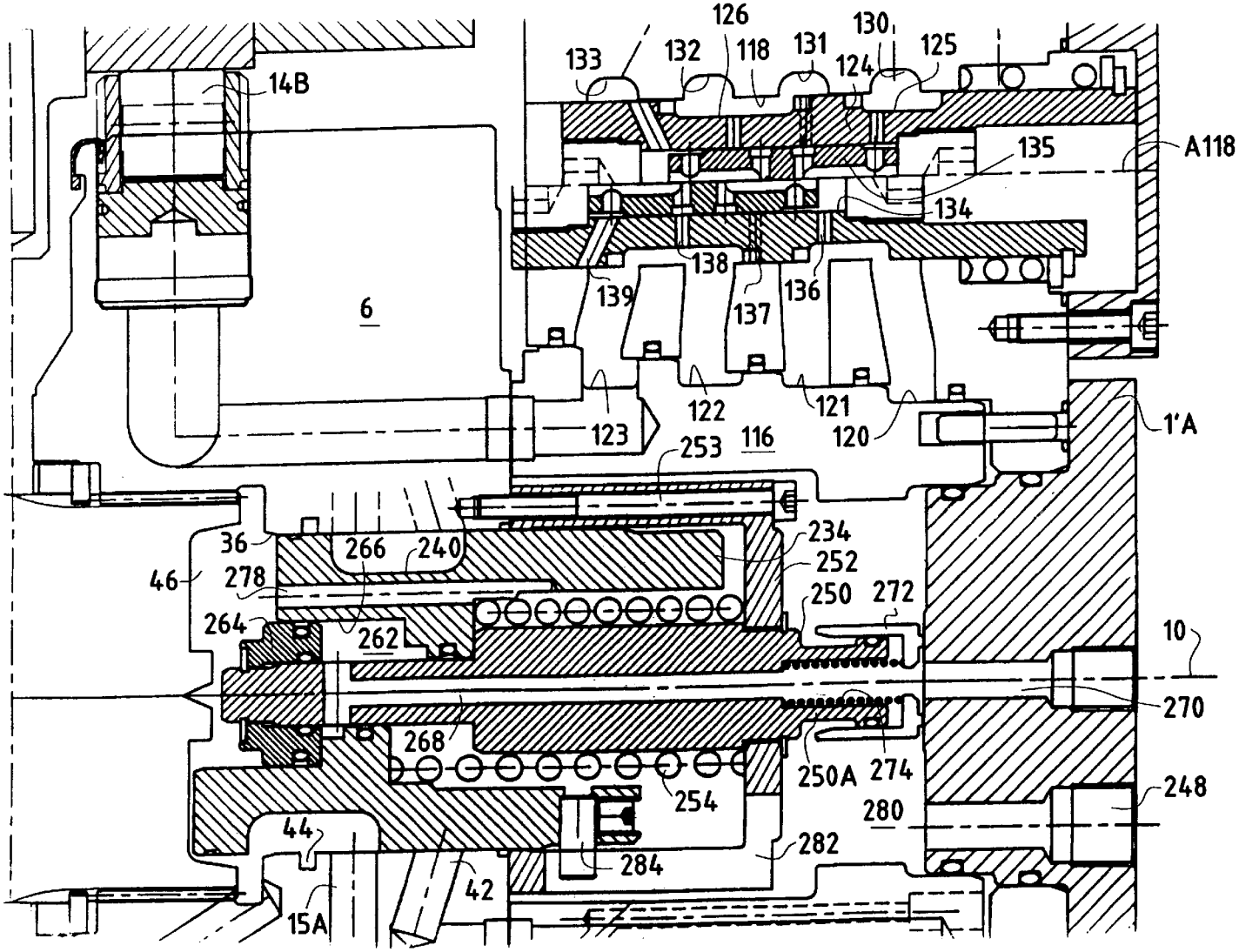
FIG. 7 is an axial view showing a variant of the control means of the selector, which is shown in its first and second positions.

FIG. 7 also shows a cubic capacity selection device that is distinct from the piston declutching selector and that comprises a slide 124 mounted to move inside a bore 118. The slide is shown in each of its two positions, respectively on either side of the axis A118 of the bore.

In a manner known per se, the distribution ducts are organized in four groups, each group being connected to a respective one of the four grooves 120 to 123 of the distributor 116, which grooves are continuously in communication with respective ones of the four grooves 120 to 133 of the bore 118. The slide 124 has two grooves 125 to 126 which, depending on its position, put the grooves 130 to 133, and thus the distribution ducts, in communication or in isolation.

For example, at high cubic capacity, the grooves 130 to 131 are connected together and are isolated from the grooves 132 to 133 which are themselves connected together. As a result, the distribution ducts connected to the grooves 120 to 121 are connected to the same main pressure (inlet or outlet main pressure), while the distribution ducts connected to the grooves 122 and 123 are at the other main pressure (outlet or inlet main pressure).

At low cubic capacity, each of the grooves 130 and 133 is isolated from the other grooves of the bore 118, while the grooves 131 and 132 are connected together. The distribution ducts connected to the grooves 120 and 123 are put at respective ones of the two main pressures and they correspond to an active cubic capacity. In contrast, the distribution ducts connected to the grooves 121 and 122 are at the same pressure, and they correspond to an inactive cubic capacity.

The slide 124 has an internal bore 134 in which a shuttle 135 is disposed. Holes 136 to 139 through the slide communicate with the internal bore 134. The shuttle 135 makes it possible to cause the holes 136 to 139 to be put in communication so that, at low cubic capacity, the grooves 131 and 132 (and thus the ducts 121 and 122 corresponding to an inactive cubic capacity) are connected automatically to that one of the grooves 130 or 133 which contains the fluid of lower pressure. The operation of this shuttle device and its advantages are described in detail in Patent FR 2 481 755.

A description follows of the control of the declutching selector 234 which is situated in the bore 36 of the cylinder block 6. This selector may be provided on its own for declutching certain pistons, and therefore, for also selecting the cubic capacity, or else, as in FIG. 7, it may be associated with a specific cubic capacity selector.

By means of its communication channels 240 analogous to the channels 40, the selector 234 can, depending on which of its first and second positions it is in, put the cylinder ducts 15A in communication with the communication passageways 42 or isolate them from said passageways.

FIG. 7 also shows the intercommunication groove 44 and the decompression chamber 46.

The selector 234 is formed by a hollow slide inside which a rod 250 extends. In this example, the rod is centered on the axis 10 of the motor, as is the selector 234. The rod 250 constitutes a "reference part" which is prevented from moving in translation relative to the cylinder block 6. More precisely, a retaining flange 252 is fixed to the cylinder block 6 by screws 243 and the rod 250 passes through the flange and is set relative thereto by a shoulder and a setting resilient ring.

The selector 234 is continuously urged back towards its second position (which can be seen below the axis 10) by a spring 254 which bears against the flange 252. It is urged towards its first position (which can be seen above the axis 10) by counter-force means which comprise a control chamber 262 provided between said selector 234 and the rod 250. More precisely, the rod carries a closure ring 264 at its end opposite from the flange 252 and the chamber 262 is provided between a setback 266 in the internal periphery of the selector 234, the rod 250 and the ring 264.

The control duct for controlling the displacement of the selector 234 comprises a first segment 268 which is provided in the rod 250 so as to open out in the chamber 262, and a second segment 270 which is provided in a portion 1'A of the casing of the motor. The segments 268 and 270 are interconnected by the rod 250 being disposed in register with the segment 270, and they are isolated from the remainder of the motor by a sealing gasket 272 disposed between the tail 250A of the rod and that casing portion 1'A against which the gasket is held in abutment by a spring 274. The gasket is of the "rotary gasket" type providing rotary sealing between two parts rotating relative to each other.

The decompression chamber 46 is connected to the space 280 which is provided between the flange 252 and the casing portion 1'A and to which the leakage return duct 248 is connected. To this end, the selector 234 is provided with at least one axial hole 278 which connects the chamber 46 to that end of the selector which is situated closer to the flange 252, and said flange is provided with at least one hole and with a slot 282 which opens into the space 280. In this example, the slot is an axial slot 282 which co-operates with a key 284 to guide the displacement of the selector 234 between its two positions.

Thus, the selectors 34 and 234 differ in that the means of controlling their displacement differ. Otherwise, they operate analogously.

What is claimed is:

1. A hydraulic motor comprising:

a fluid inlet duct and a fluid outlet duct;

a cylinder block having an axis of rotation and including at least a first group of cylinders disposed radially relative to said axis of rotation, each cylinder being connected to a cylinder duct and co-operating with a piston suitable for sliding in said cylinder;

a reaction member mounted to rotate relative to said cylinder block about said axis of rotation;

an internal fluid distributor constrained to rotate with said reaction member about said axis of rotation and provided with distribution ducts suitable for being connected to said cylinder ducts so as to put said ducts in communication with said fluid inlet and fluid outlet ducts of the motor; and selection means suitable, in a first configuration, for making it possible to connect the cylinder ducts of the cylinders of the first group to the distribution ducts and, in a "piston-declutching" second configuration, for putting said cylinder ducts in communication with a fluid discharge enclosure, the pistons co-operating with the cylinders of the first group being suitable, in said declutching configuration, for being retracted into said cylinders towards said axis of rotation;

said selection means comprising a single declutching selector constrained to rotate with said cylinder block about said axis of rotation and provided with a communication duct for each cylinder of the first group of cylinders, said selector being suitable for taking up a first position, corresponding to said first configuration, in which the communication ducts make it possible to connect the cylinder ducts of the cylinders of the first group to the distribution ducts, a second position corresponding to said declutching configuration, and an intermediate transitional position between said first and second positions, and in which the cylinder ducts of the cylinders of the first group are connected together via an isolated enclosure.

2. A motor according to claim 1, wherein the declutching selector is formed by a slide mounted to slide in a bore in the cylinder block, the communication ducts comprising communication channels provided in the surface of the slide, wherein the cylinder ducts of the cylinders of the first group have orifices that are open in said bore in the cylinder block, each of the orifices being continuously connected to a respective communication channel, and wherein the bore in the cylinder block is provided with an intercommunication groove to which the communication channels are connected when the declutching selector is in the transitional position.

3. A motor according to claim 2, wherein, for each cylinder duct of the cylinders of the first group, said motor has a distribution passageway formed by a duct that has a first orifice open in the bore of the cylinder block and a second orifice open in a communication face of the cylinder block so as to be connected to the distribution ducts during the relative rotation of the cylinder block and of the distributor, and wherein, for each cylinder duct of the cylinders of the first group, the first orifice of the duct forming the distribution passageway, the orifice of the cylinder duct and the intercommunication groove are successively disposed in the bore of the cylinder block in the direction in which the slide of the declutching selector is displaced from its first position to its second position.

4. A motor according to claim 3, wherein, for each cylinder duct of the cylinders of the first group, the minimum distance, as measured in the displacement direction of the declutching selector, between the intercommunication groove and the first orifice of the duct forming the distribution passageway associated with said cylinder duct is less than the length of the communication channel associated with said cylinder duct.

5. A motor according to claim 1, further comprising control means for causing the declutching selector to be displaced between its first and second positions, which control means comprise resilient return means suitable for continuously urging said selector towards one of its first and second positions, and counter-force means suitable for being controlled so as urge the selector towards the other of its first and second positions.

6. A motor according to claim 5, wherein the resilient return means urge the selector towards its first position, and wherein the counter-force means comprise a control piston co-operating with a control cylinder secured to a stator portion of the motor, said control piston being suitable for being displaced against the return force of said return means so as to urge the selector towards its second position.

7. A motor according to claim 6, wherein the control piston co-operates with the declutching selector via spherical abutment means.

8. A motor according to claim 6, wherein the control piston co-operates with the declutching selector via ball or roller means.

9. A motor according to claim 6, wherein the control piston co-operates with the declutching selector via hydrostatic abutment means using a confined fluid.

10. A motor according to claim 5, wherein the counter-force means comprise a control chamber provided between the selector and a reference part fixed relative to the cylinder block, and a control duct suitable for connecting said control chamber to a fluid source.

11. A motor according to claim 5, wherein the resilient return means urge the selector towards its second position, and wherein the counter-force means are suitable for being controlled to urge the selector towards its first position.

12. A motor according to claim 10, wherein the control duct comprises a first segment provided in the reference part and a second segment provided in a casing portion of the motor, said first and second segments being connected together via rotary sealing means.

13. A motor according to claim 1, wherein a decompression chamber is provided at that end of the declutching selector which is situated on the downstream side thereof in the direction in which it is displaced from its first position to its second position, and wherein, when said selector is in its second position, the cylinder ducts of the cylinders of the first group are connected to said chamber.

14. A motor according to claim 13, wherein the decompression chamber is in communication with a leakage return duct connected to a pressure-free tank.

15. A motor according to claim 14, wherein the decompression chamber is connected to the fluid return duct via at least one passageway of small cross-section.

16. A motor according to claim 13, wherein the decompression chamber is in communication with the inside space of the motor that is situated under the reaction member via a non-return valve allowing fluid to flow only in the direction in which said chamber is emptied.

17. A motor according to claim 1, wherein the inside space of the motor that is situated under the reaction member is in communication with a leakage return duct connected to a pressure-free tank via a calibrated valve.

18. A motor according to claim 1, wherein the cylinder block has a second group of cylinders disposed radially relative to the axis of rotation, each cylinder of the second group being connected to a respective cylinder duct which is connected directly to a communication face of the cylinder block, which face co-operates with a distribution face of the distributor, so as to be connected to the distribution ducts during the relative rotation of the cylinder block and of the distributor, independently of the position of the declutching selector.

19. A motor according to claim 18, wherein the cylinders of the first group of cylinders have their axes contained in a first radial plane, while the cylinders of the second group of cylinders have their axes contained in a second radial plane distinct from said first plane.

20. A motor according to claim 1, further comprising a selection device for selecting the connection between the distribution ducts and the fluid inlet and outlet ducts, which device co-operates with the distributor and has a first configuration in which all of the distribution ducts are active, and a second configuration in which certain distribution ducts are inactive so that, when a cylinder duct communicates with one of the distribution ducts, the pressure of the fluid in the inlet direction and/or in the outlet direction of the cylinder connected to said cylinder duct is such that the work effected by the piston of the cylinder during a cycle is zero.

* * * * *